US007104539B2

(12) United States Patent
Shimoyama

(10) Patent No.: US 7,104,539 B2
(45) Date of Patent: Sep. 12, 2006

(54) SHEET MATERIAL FEEDING DEVICE AND RECORDING APPARATUS

(75) Inventor: Noboru Shimoyama, Ohta-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 10/449,107

(22) Filed: Jun. 2, 2003

(65) Prior Publication Data

US 2003/0230844 A1 Dec. 18, 2003

(30) Foreign Application Priority Data

Jun. 18, 2002 (JP) ..... 2002-177147

(51) Int. Cl.
*B65H 3/34* (2006.01)

(52) U.S. Cl. ..... 271/167; 271/121; 271/122

(58) Field of Classification Search ..... 271/167, 271/119, 121, 122, 124, 126, 117, 118
See application file for complete search history.

(56) References Cited

U.S. PATENT DOCUMENTS 5,316,285 A * 5/1994 Olson et al. ..... 271/122
5,527,029 A * 6/1996 Bortolotti et al. ..... 271/124
5,992,993 A 11/1999 Kiyohara et al. ..... 347/104
6,045,220 A 4/2000 Kiyohara et al. ..... 347/104
6,168,150 B1 * 1/2001 Hori et al. ..... 271/121
6,199,855 B1 * 3/2001 Choeng et al. ..... 271/122
6,485,015 B1 * 11/2002 Yen et al. ..... 271/121
6,663,098 B1 * 12/2003 Teo et al. ..... 271/121

FOREIGN PATENT DOCUMENTS

JP 2-193834 7/1990
JP 8-40589 2/1996

* cited by examiner

*Primary Examiner*—Eileen D. Lillis
*Assistant Examiner*—Kaitlin Joerger
(74) *Attorney, Agent, or Firm*—Fitzpatrick, Cella, Harper & Scinto

(57) ABSTRACT

A sheet material feeding device for sending out sheet materials mounted on a sheet material mounting portion one by one by a feeding roller, includes an elastic member with the angle changed elastically by being abutted against by the sheet materials sent out, for separating the sheet materials by being moved over by the sheet materials, and a return assisting unit to be contacted with the elastic member for facilitating the return of the angle change of the elastic member to the original state.

26 Claims, 7 Drawing Sheets

SHEET MATERIAL FEEDING DEVICE AND RECORDING APPARATUS

BACKGROUND OF THE INVENTION

1. Field of the Invention

The present invention relates to a sheet material feeding device for feeding a sheet material (a recording paper, a transfer paper, a photosensitive paper, an electrostatic recording paper, a printing paper, an OHP sheet, an envelope, a postcard, a sheet document, or the like) mounted on a sheet material mounting portion to a sheet material processing portion such as a recording portion, a reading portion, and a processing portion in a recording apparatus (printer) as an information outputting apparatus for a personal computer, or the like, an image forming apparatus such as a copying machine and a facsimile, or various other kinds of sheet material using appliances, and a recording apparatus comprising the sheet material feeding device.

2. Related Background Art

According to a sheet material feeding device for sending out sheet materials mounted on a sheet mounting portion, a function of certainly separating and feeding (sending out) the mounted sheet materials one by one. For example, Japanese Patent Application Laid-Open No. 2-193834 discloses a sheet material feeding device required to separate various sheet materials with different bending elastic modules provided with the function. According to this, in a sheet material feeding device for sending out the sheet materials by forcing a sheet material mounting base with sheet materials forced toward a feeding roller with a spring, and rotating the feeding roller, an elastic member is disposed in a direction perpendicular to the sheet material feeding direction so that the sheet materials are separated one by one by deflecting the elastic member.

However, according to the sheet material feeding device, since the sheet material mounting base is always forced toward the feeding roller, in the case not only the uppermost sheet material but also subsequent sheet materials are pushed out, the top end portion of the subsequent sheet materials may be abutted against the elastic member so as to be interposed and maintained between the sheet material mounting base and the feeding roller in a state with the elastic member deflected. In the case a feeding operation is further executed for the subsequent sheets, a sufficient separating effect by the elastic member cannot be obtained so that the superimposed feed of the sheet materials (feed with a plurality of sheets superimposed) may be generated.

As means for solving the problem, for example, Japanese Patent Application Laid-Open No. 8-40589 discloses one comprising means for releasing the pressure contact force between the sheet material mounting base and the feeding roller after separating and feeding the first sheet material to the device main body. According to the means, since the elastic member in the deflected state can return to the original state by its own elastic returning force, the subsequent sheet materials are pushed back to the initial mounting position so that generation of the superimposed feed of the subsequent sheet materials at the time of the feeding operation can be avoided.

However, according to the conventional sheet material feeding device comprising the means for releasing the pressure contact force between the sheet material mounting base and the feeding roller has the following technical problem to be solved. That is, although the pressure contact force between the sheet material mounting base and the feeding roller is released after separating the first sheet material and feeding the same to the device main body, since the force of returning the elastic member in the deflected state to the original state is only the own elastic force of the elastic member, in the case a load exists in the process of returning the subsequent sheet materials to the initial state, a risk is involved in that the sheet materials cannot be pushed back completely. Moreover, even in the case the elastic member returns to the original state, the subsequent sheet materials is maintained in a state hooked by the elastic member without completely returning to the initial mounting position. Therefore, a risk is involved in that a sufficient separating effect by the elastic member may not be obtained due to the factors so that the superimposed feed of the subsequent sheet materials may be generated in the feeding operation.

SUMMARY OF THE INVENTION

The present invention has been achieved in view of the technical problems, and an object of the present invention is to provide a sheet material feeding device capable of completely returning to the initial state of an elastic member after sending out a first sheet material and certainly pushing back the subsequent sheet materials to the initial mounting state, and avoiding the superimposed feed of the subsequent sheet materials due to the insufficient separating force of the elastic member, and a recording apparatus comprising the sheet material feeding device.

In order to achieve the above-mentioned object, the present invention provides a sheet material feeding device for sending out sheet materials mounted on a sheet material mounting portion one by one by a feeding roller, comprising an elastic member with the angle changed elastically by being abutted against by the sheet materials sent out, for separating the sheet materials by being moved over by the sheet materials, and return assisting means to be contacted with the elastic member for facilitating the return of the angle change of the elastic member to the original state.

DESCRIPTION OF THE PREFERRED EMBODIMENT

Figure 1:
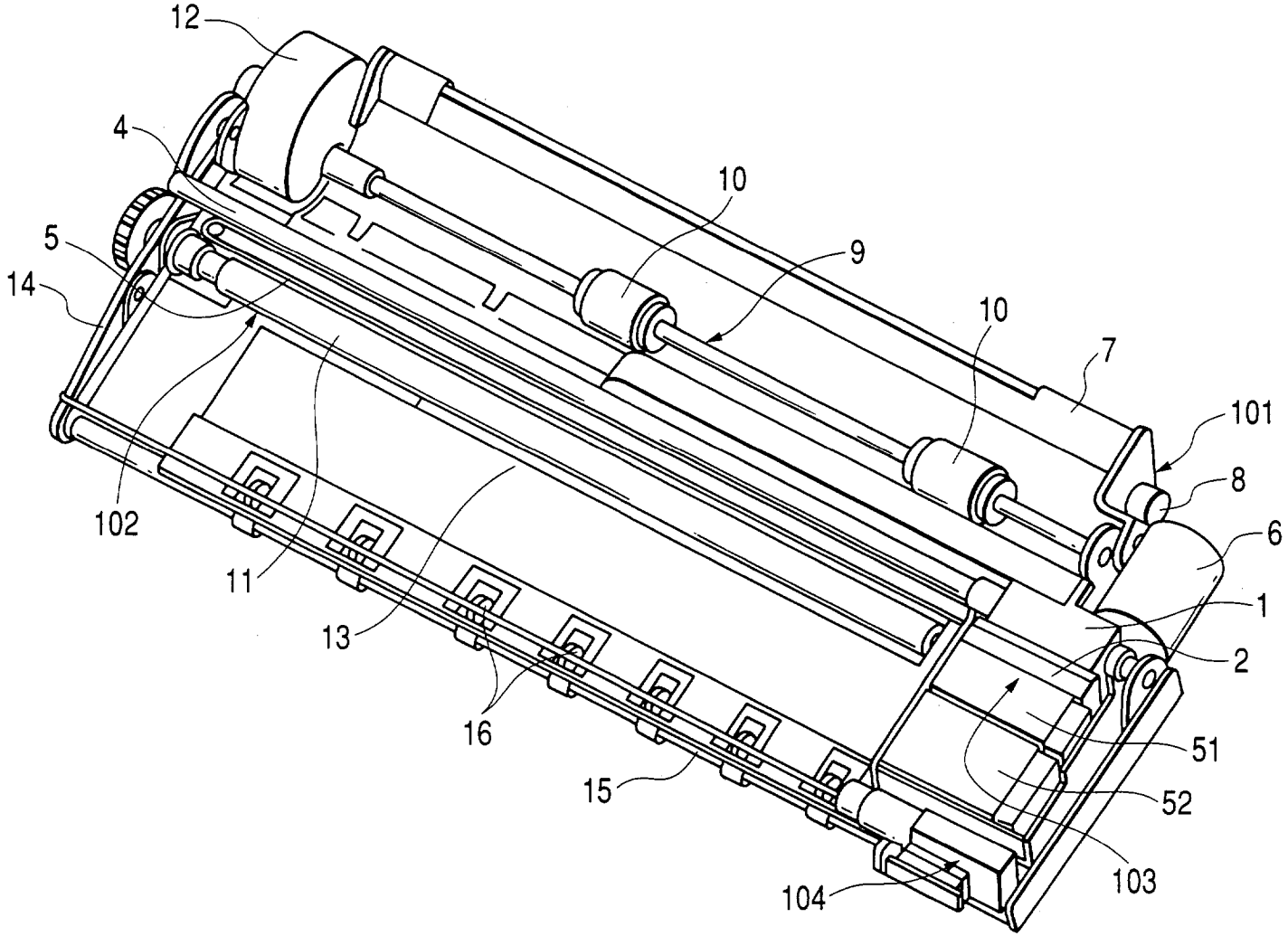
FIG. 1 is a schematic perspective view showing an embodiment of a recording apparatus comprising a sheet material feeding device of the present invention.
Figure 2:
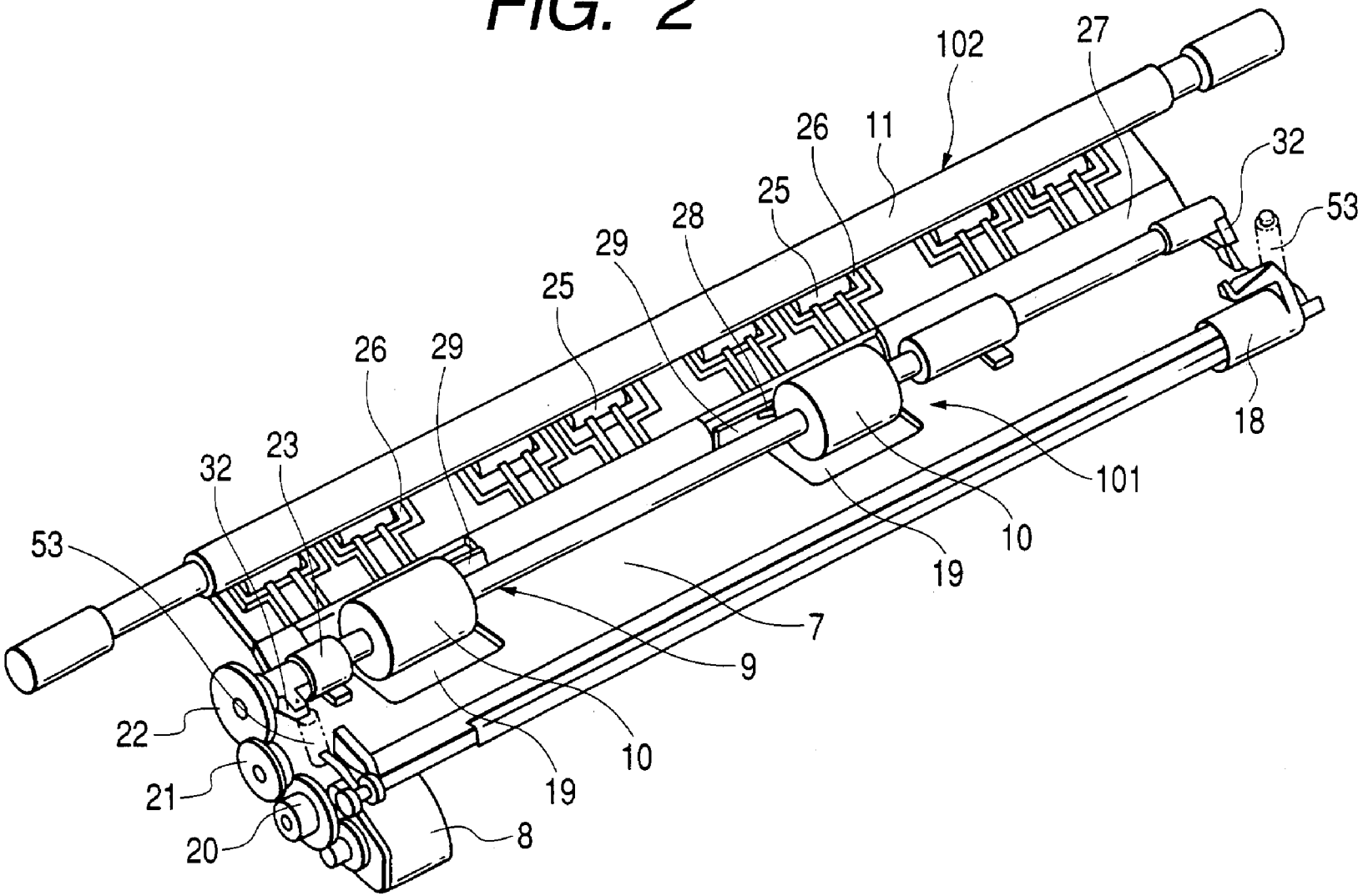
FIG. 2 is a schematic perspective view showing an embodiment of a sheet material feeding device of the present invention.

Hereinafter, an embodiment of the present invention will be explained specifically with reference to the drawings. The same numerals in the drawings refer to the same or corresponding parts. FIG. 1 is a schematic perspective view of an embodiment of a recording apparatus with a sheet material feeding device of the present invention mounted, and FIG. 2 is a schematic perspective view of a sheet material feeding device of the present invention. FIG. 1 shows the case of the recording apparatus with the sheet material feeding device mounted is an ink-jet recording apparatus. In FIG. 1, the recording apparatus (ink-jet recording apparatus) is provided with a sheet material feeding device (sheet material feeding means) 101, sheet material conveying means 102, recording means 103 and return means 104.

Sheet materials P (see FIGS. 3 to 6) mounted on a pressure plate 7 as the mounting plate for sheet material feeding means (sheet material feeding device) 101 are separated one by one by a feeding roller (paper feeding roller) 9 to be driven by a feeding roller 8 so as to be sent out and introduced to conveying means 102. The above-mentioned pressure plate 7 comprises a sheet mounting portion. The above-mentioned feeding roller (paper feeding roller) 9 is provided with a feeding roller rubber (paper feeding roller rubber) 10 for generating the pushing force by being contacted with the surface of the uppermost layer of the mounted sheet materials P with pressure. The sheet material P introduced to the conveying means 102 is sent out to a platen 13 by a conveying roller 11 to be driven by a conveying motor 12.

To the sheet material P sent out on the platen 13, an image (including characters, marks, or the like) is recorded by a recording head 2 of the recording means 103, that is, a recording head 2 having ink tanks 51 and 52 mounted on a carriage 1. To the carriage 1, the driving force of a carriage motor 6 is transmitted via a carriage belt 5 so that the carriage 1 is moved reciprocally along a guide shaft 4 by the driving force of the carriage motor 6. By repeating the recording operation of the recording head 2 executed synchronously with the reciprocal movement (main scanning) of the above-mentioned carriage 1 and the conveyance feeding (sub scanning) of the sheet material P per a predetermined pitch, the recording operation is executed for the entirety of the sheet material P. The sheet material P with the recording operation finished is fed out by the conveying roller 11 to a discharge roller 15 so as to be discharged while being clamped between the discharge roller 15 and a spur 16.

The drive of the above-mentioned conveying motor 12 is transmitted also to the above-mentioned discharge roller 15 via a discharge belt 14 so that the discharge roller 15 is rotated and driven simultaneously with the above-mentioned conveying roller 11. At the time, by having the circumferential speed (conveyance speed) of the discharge roller 15 slightly higher than the circumferential speed (conveyance speed) of the conveying roller 11, an appropriate tension is applied to the sheet material P being conveyed. The above-mentioned return means 104 is for maintaining and restoring the recording quality in a normal (preferable) state by solving choking, or the like of the recording head (ink-jet head) 2 in an ink-jet recording apparatus, and in general, it comprises pump means (not shown) for vacuuming or ejecting an ink from an ejection opening, cap means (not shown) for covering the ejection opening, wiping means (not shown) for wiping and cleaning the ejection opening surface, or the like.

In FIG. 2 showing the sheet material feeding means (sheet material feeding device) 101 of the present invention, a plurality of sheet materials P are mounted on the pressure plate 7 as the sheet material mounting portion at the time of use with the sheet materials on the pressure plate 7 positioned by a paper guide 18. The pressure plate 7 is forced toward the feeding roller 9 by pressure plate springs 53, 53 engaged on the both side portions thereof. Projecting portions 7*a*, 7*a* provided on the both sides of the pressure plate 7 can be contacted with cam members 32, 32 rotated integrally with the feeding roller 9 by a predetermined timing. That is, at the time the above-mentioned cam members 32, 32 are rotated together with the above-mentioned feeding roller 9, according to the separation and the contact of the cam members 32, 32 and the above-mentioned projecting portions 7*a*, 7*a* by a predetermined timing, the sheet material mounting portion 7 (the sheet materials P on the pressure plate 7) can be switchably contacted or separated with the feeding roller 9 (feeding roller rubber 10) by a predetermined timing. Furthermore, a separating sheet 19 is provided at a part of the pressure plate 7 facing the feeding roller rubber 10 on the above-mentioned feeding roller 9 for generating a relatively large friction force with respect to the sheet materials P. The separating sheet 19 is for preventing superimposed feed of the sheet materials P at the time of the feeding operation (at the time of the paper feeding operation) by providing the friction force between the sheet materials P and the pressure plate 7.

That is, according to the above-mentioned sheet material feeding device (means) 101, switching means or mounting plate moving means for operating the sheet material mounting portion (pressure plate) 7 so as to be contacted with the feeding roller 9 at the time of feeding the sheet materials by the cam members (feeding roller cams) 32, 32 to be rotated integrally with the feeding roller 9, and separating the sheet material mounting portion 7 from the feeding roller 9 after finishing the sheet material feeding operation. That is, the switching means comprises pressure plate springs 53, 53 as forcing means for forcing the above-mentioned sheet material mounting portion 7 in the direction to be contacted with the above-mentioned feeding roller 9, and the cam members (feeding roller cams) 32, 32 for separating the above-mentioned sheet material mounting portion 7 from the above-mentioned feeding roller 9, resisting to the forcing force of the pressure plate springs 53, 53.

Figure 3:
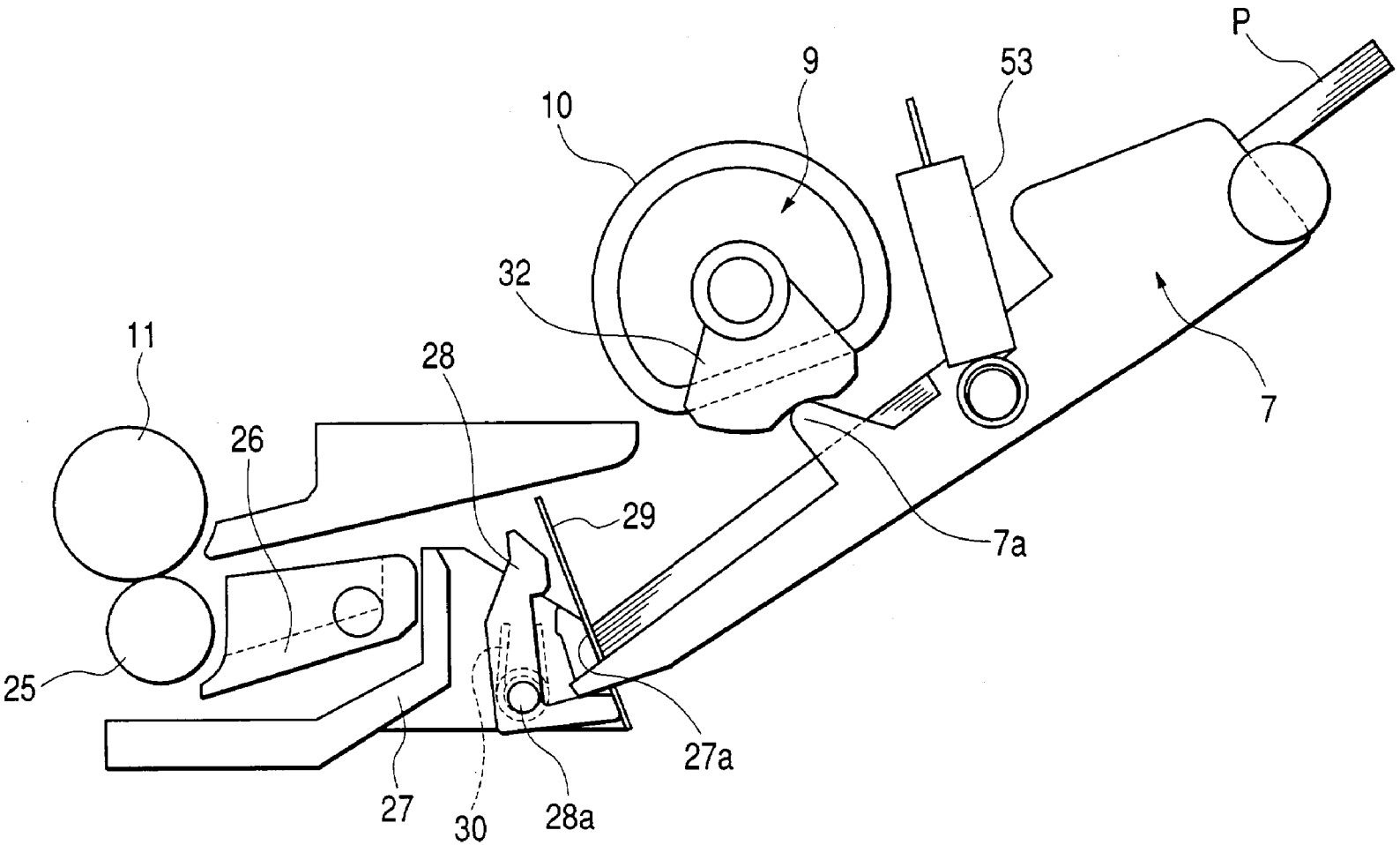
FIG. 3 is a schematic side view of an embodiment of a sheet material feeding device of the present invention in a state with a feeding roller at a standby position (rotation angle 0 degree).
Figure 4:
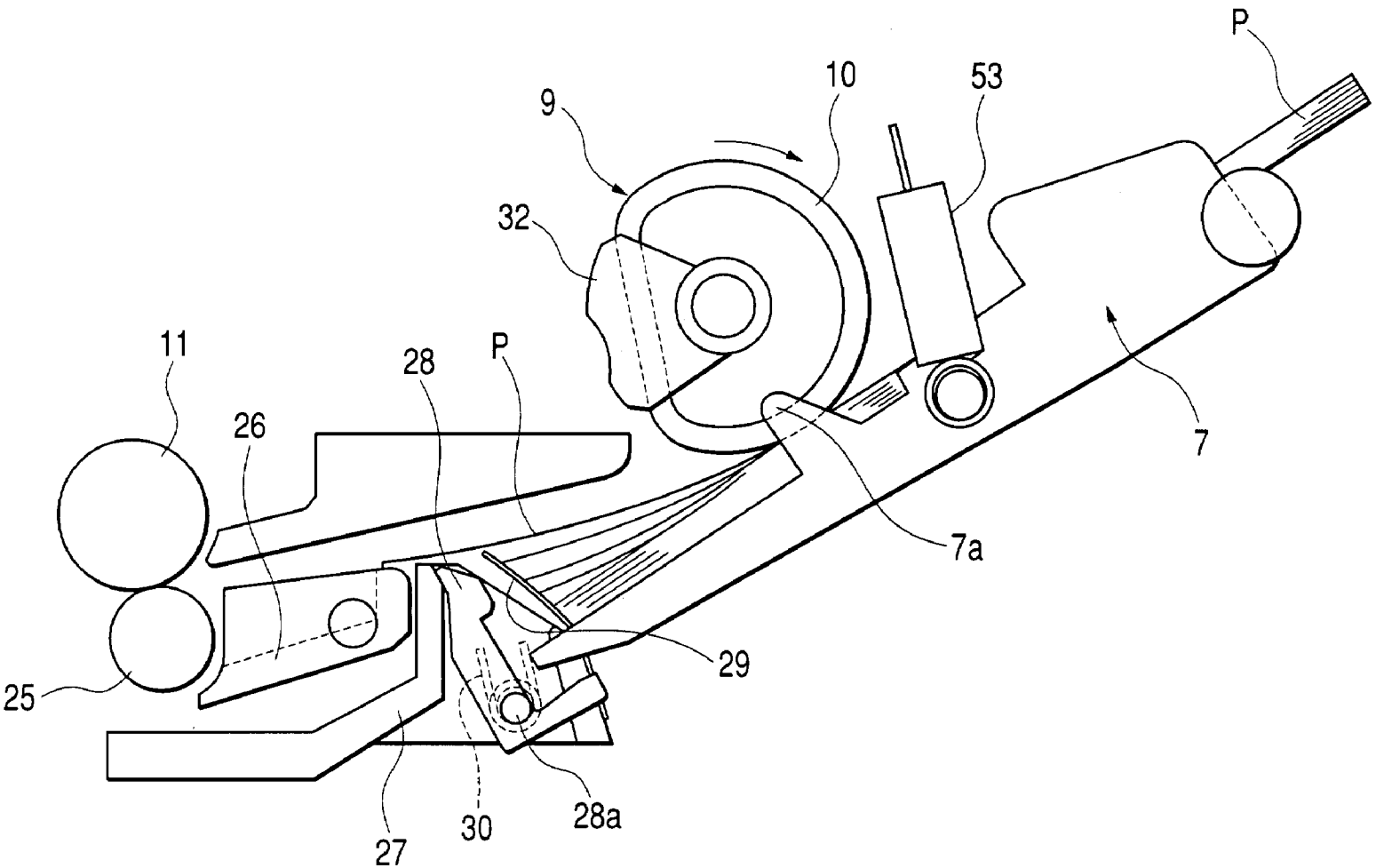
FIG. 4 is a schematic side view of the sheet material feeding device of FIG. 3 in a state with the feeding roller rotated for separating the sheet materials by the feeding roller (for example, a position with a 100 degree feeding roller rotation angle).
Figure 5:
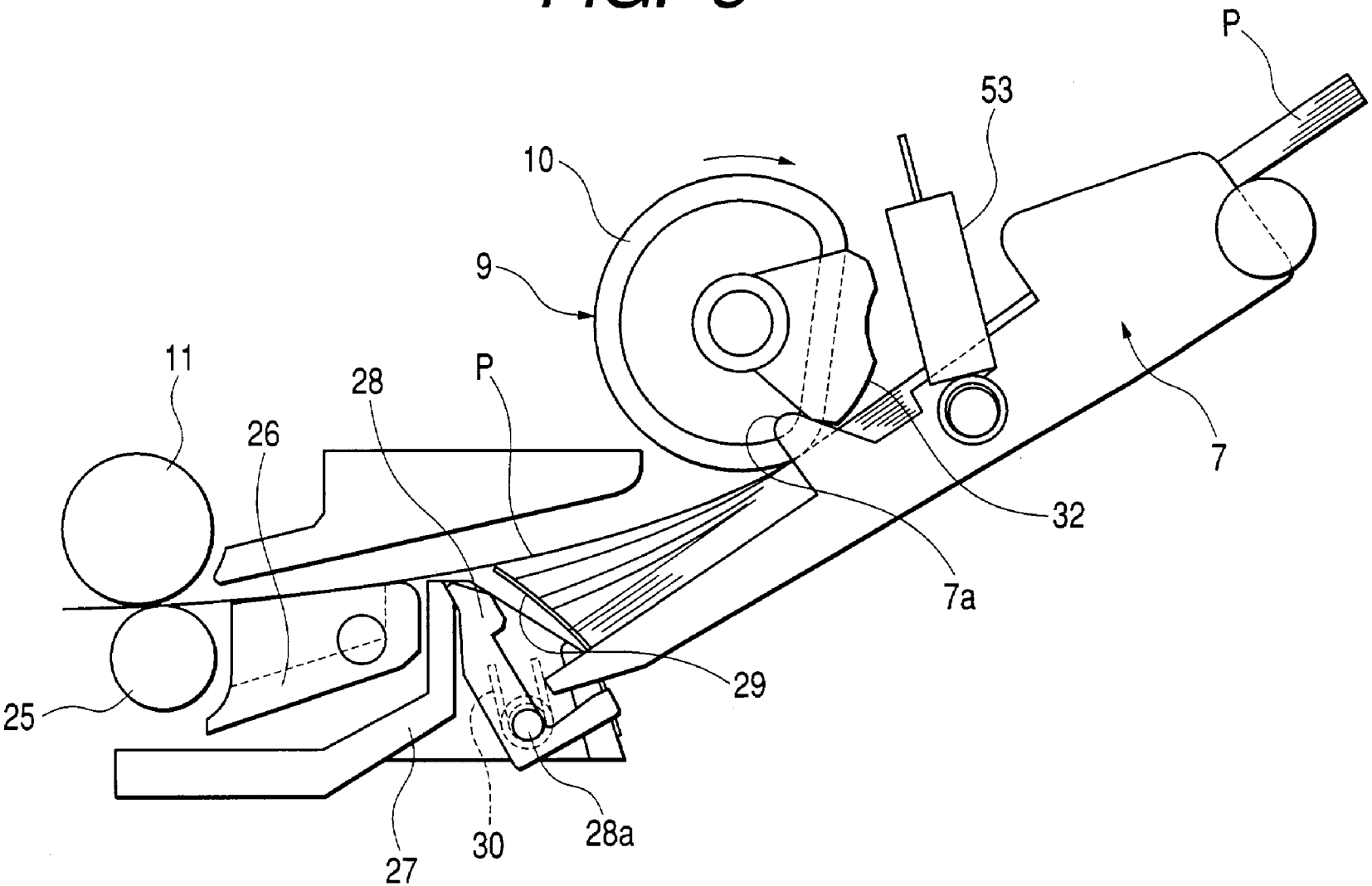
FIG. 5 is a schematic side view of the sheet material feeding device of FIG. 3 in a state with the feeding roller further rotated from the position of FIG. 4 for having the separated sheet material fed to a conveying roller (for example, a position with a 300 degree feeding roller rotation angle).
Figure 6:
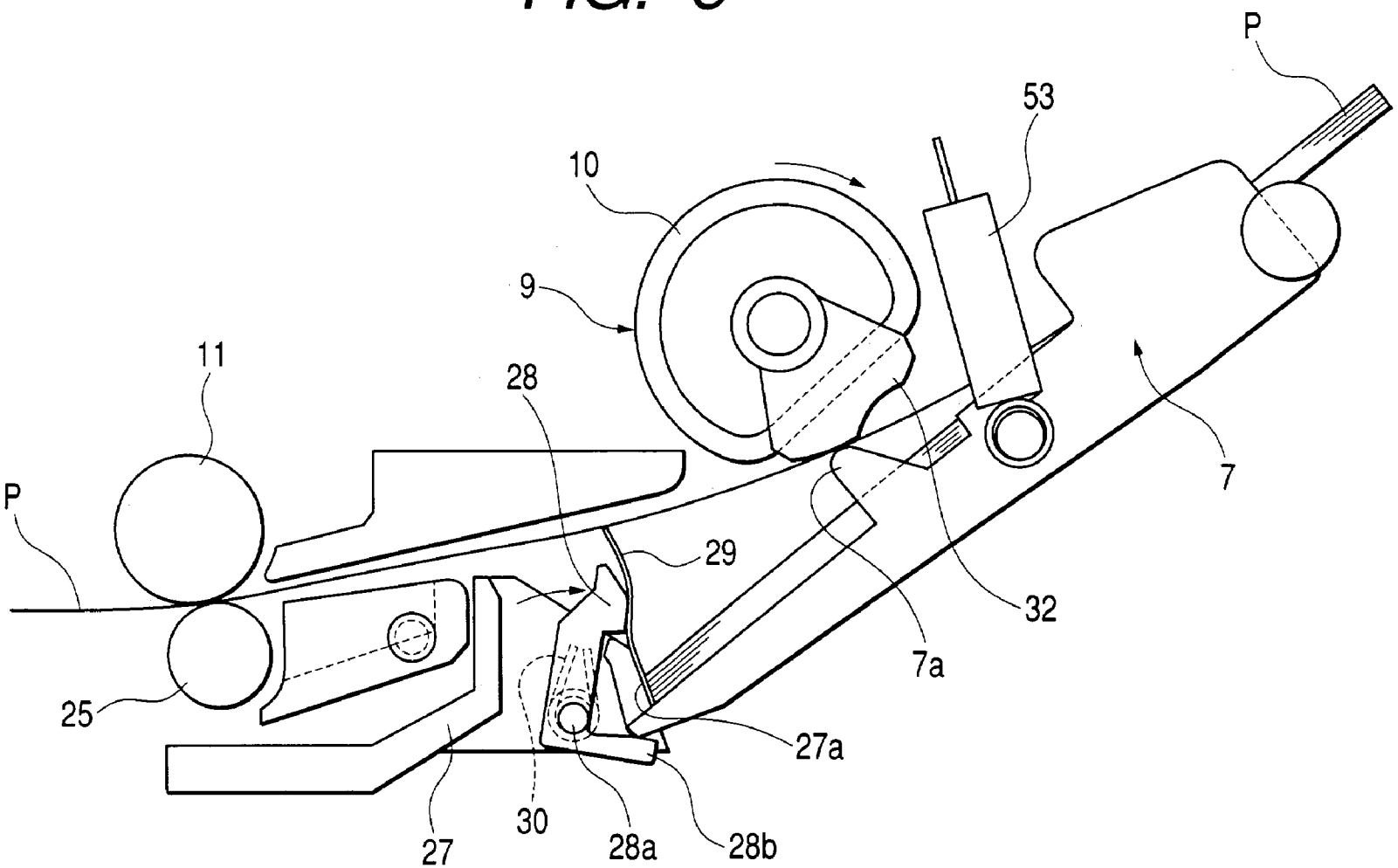
FIG. 6 is a schematic side view of the sheet material feeding device of FIG. 3 in a state with the feeding roller further rotated from the position of FIG. 5 so that a return assisting member is rotated by a sheet material mounting portion being pressed down so as to pressure the elastic member in the return direction for having the subsequent sheet materials are returned to the sheet material mounting portion (for example, a position with a 335 degree feeding roller rotation angle).

FIGS. 3, 4, 5 and 6 are partial side views showing the operation of the feeding roller cams 32 to be rotated integrally with the feeding roller 9, the pressure plate 7 as the sheet material mounting portion, and a return lever 28 as a return assisting member or a pushing member successively. In this embodiment, FIG. 3 shows the state at the time the feeding roller 9 is at a rotation angle 0 degree position, FIG. 4 shows the state at the time the feeding roller 9 is at a rotation angle 100 degree position, FIG. 5 shows the state at the time the feeding roller 9 is at a rotation angle 300 degree position, and FIG. 6 shows the state at the time the feeding roller 9 is at a rotation angle 335 degree position.

In FIGS. 2 and 3, the feeding roller (paper feeding roller) 9 is pivoted rotatably by a chassis (not shown) via a bearing 23 so as to be rotated and driven according to transmission of the driving force of the feeding motor 8 via idle gears 20, 21 and a feeding roller gear 22. A guide member 27 is provided on the downstream side of the pressure plate 7 in the sheet material conveying direction. A top end limiting surface 27*a* to be contacted with the top end of the mounted sheet materials P is formed in a part toward the above-mentioned pressure plate 7 of the guide member 27 such that a sheet-like elastic member 29 (separating member) for separating the uppermost layer sheet material at the time of the feeding operation is fixed on the top end limiting surface 27*a* in a cantilever-like form. The sheet materials P to be sent out by the feeding roller 9 are separated by the elastic member 29 fixed on the above-mentioned guide member 27 so as to be sent out one by one to the conveying means 102 side. In the embodiment shown in the figures, the above-mentioned elastic member 29 comprises a thin plate-like elastically displaceable (angle change) member provided upright in the direction orthogonal to the sheet material feeding direction (substantially perpendicular direction). That is, the elastic member 29 is in general in a upright state as shown in FIG. 3, however it has an elastic angle change in the case the top end of the sheet materials P sent out by the feeding roller 9 (feeding roller rubber 10) is abutted against thereto as shown in FIGS. 4 and 5. At the time the sheet materials P move over the elastic member 29 with the angle change, one sheet in the uppermost layer is separated.

The return lever 28 is provided as the return assisting member supported rotatably around a spindle 28*a* by the above-mentioned guide member 27 on the downstream side of the above-mentioned elastic member 29 in the sheet material sending direction. The return lever 28 is provided engageably with the top end part of the above-mentioned pressure plate 7 so as to function as a return assisting member (return assisting means) for facilitating return of the angle change (elastic deflection) of the elastic member 29 to the original state by contacting with the rear surface of the above-mentioned elastic member 29 utilizing the movement of the top end part of the pressure plate 7 as shown in FIG. 6. Moreover, a pinch roller 25 pivoted rotatably by a pinch roller holder 26 is pressured against the conveying roller 11 of the above-mentioned conveying means 102 by spring means so that the sheet material P fed out from the sheet material feeding means 101 and introduced between the conveying roller 11 and the pinch roller 25 is conveyed through the recording portion according to the rotation of the conveying roller 11.

Figure 7:
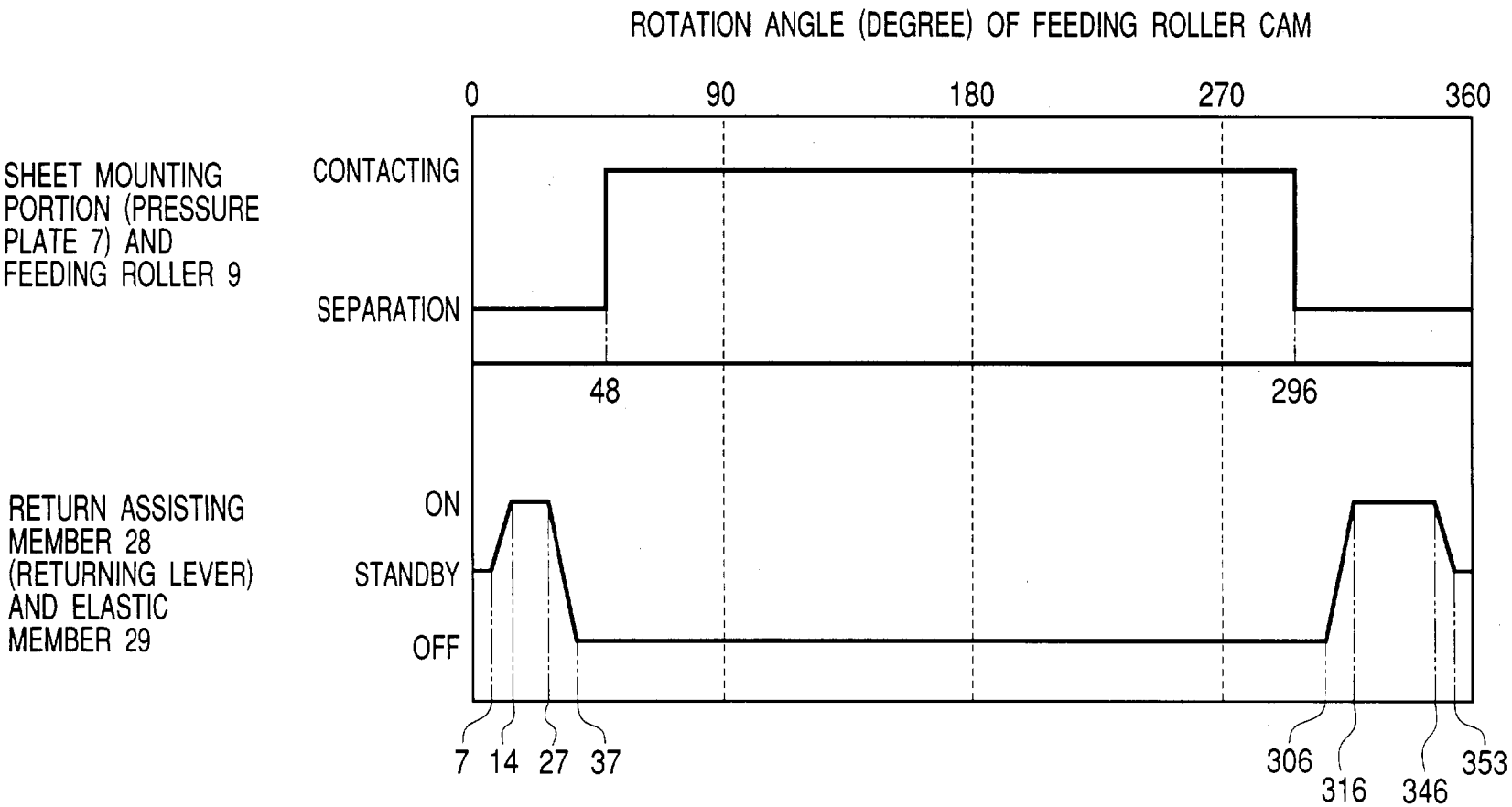
FIG. 7 is a timing chart showing an operation of an embodiment of a sheet material feeding device of the present invention with the feeding roller cam rotation angle provided as the reference.

FIG. 7 is a timing chart showing the operation of the feeding roller 9 and the sheet material mounting portion (pressure plate) 7 and the operation of the return assisting member (return lever) 28 and the elastic member 29 with respect to the rotation angle of the roller cam 3 shown in FIGS. 3 to 6. FIGS. 3 to 6 are operation explanatory diagrams showing the relationship between the feeding roller cam 32 to be rotated integrally with the feeding roller 9, the pressure plate 7 and the return lever 28 at the time the mounting thickness (mounting height) of the sheet materials P is about 2 mm. FIG. 7 is a timing chart of each operation in FIGS. 3 to 6. Hereinafter, with reference to FIG. 7, the operation of FIGS. 3 to 6 will be explained.

FIG. 3 shows the state of the feeding roller (paper feeding roller) 9 at the feeding standby position. The rotation angle (rotation position) of the feeding roller cam 32 in this state is set at 0 degree as shown in FIG. 7. At the rotation angle 0 degree position, the sheet material mounting portion 7 (specifically, the sheet materials P mounted on the pressure plate 7) is disposed at the pressure plate standby position away from the feeding roller 9. The return lever (return assisting member) 28 is supported at the rotated position away from the above-mentioned elastic member 29, resisting to the return lever spring 30 (forcing means) by the top end part of the pressure plate 7 pressured, resisting to the pressure plate spring (forcing means) 53 by the feeding roller cam 32 as shown in FIG. 3. At the position shown in FIG. 3, the above-mentioned return lever 28 is not contacted with the above-mentioned elastic member 29, but it is disposed at a position projecting from the above-mentioned guide member 27. This state is referred to as the return lever 28 stand by position.

In FIGS. 3 to 7, in the case the feeding roller cam 32 and the feeding roller 9 are stated to be rotated in the clockwise direction from the feeding roller cam rotation angle 0 degree position as shown in FIG. 3, the pressure plate 7 is moved (approached) gradually to the feeding roller 9 side along the feeding roller cam 32. In FIG. 7, at the time the feeding roller cam 32 is rotated by 28 degrees, the pressure plate 7 is separated completely from the return lever 28 so that the return lever 28 is in the state embedded in the guide member 27 (the OFF position as shown in FIG. 4) by the forcing force of the return lever spring 30 such that the return lever 28 does not influence the feeding operation. Then, as shown in FIG. 7, at the time the feeding roller cam 32 reaches at the 48 degree rotation position, the pressure plate 7 is moved to the pressure plate feeding position in contact with the feeding roller 9 so as to start the feeding operation (sheet material sending out operation).

FIG. 4 shows the state with the feeding roller cam 32 at a position rotated by 100 degrees in FIG. 4 such that the sheet materials P mounted on the pressure plate 7 as the sheet material mounting portion are sent out to the conveying roller 11 according to the clockwise rotation of the feeding roller 9. At the time, as shown in FIG. 4, the sheet materials P are abutted against the elastic member 29 so as to be separated one by one while generating an elastic angle change (elastic deflection) to the elastic member 29. At the time, subsequent several sheet materials may be clamped between the pressure plate 7 and the feeding roller 9 in a state climbing up halfway on the deflected elastic member 29 as shown in FIG. 4.

FIG. 5 shows the state with the feeding roller cam 32 at a position rotated by 300 degrees in FIG. 7. At the time, the sheet materials P are clamped between the conveying roller 11 and the pinch roller 25. As shown in FIG. 5, according to the contact of the feeding roller cam 32 again with the projecting portion 7*a* of the pressure plate 7, the pressure plate 7 as the sheet material mounting portion is pressed down. At the time the feeding roller cam 32 comes to the 296 degree rotation position as shown in FIG. 7, the sheet material mounting portion 7 is separated from the feeding roller 9 so as to complete the sheet material P sending out operation (feeding operation). At the time, the subsequent sheet materials P abutted against and climbing up halfway the elastic member 29 may be returned to the sheet material mounting portion (the original position on the pressure plate 7) only by the elastic force of the elastic member 29, or they may be sustained without returning to the original position only by the elastic force in the case the elastic force of the elastic member 29 is weak. Therefore, according to this embodiment, the return assisting means as explained below is provided.

FIG. 6 shows the state with the feeding roller cam 32 at a position rotated by 335 degrees in FIG. 7. In this state, the pressure plate 7 as the sheet material mounting portion is further pressed down by the feeding roller cam 32 so that the return lever 28 is rotated clockwise so as to be contacted with the rear surface of the above-mentioned elastic member 29, resisting to the lever spring (forcing means) 30 according to engagement of the top end part of the pressure plate 7 with the contact portion 28*b* of the return lever 28 as the return assisting member. Then, the return lever 28 is rotated to a position (the ON position in FIG. 7) capable of pushing back the subsequent sheet materials P climbing up on the above-mentioned elastic member 29 to the original position on the pressure plate 7 as the sheet material mounting portion. The elastic member 29 is pushed by the return lever so as to be tilted to the sheet mounting portion side with respect to the standby state. The top end of the sheet materials P mounted on the pressure plate 7 is limited by the top end limiting surface 27*a*.

Thereby, the subsequent sheet materials after separating and feeding a sheet material can return to (restore) the initial mounting state. Then, at the time the feeding roller cam 32 is further rotated so as to be disposed at the 360 degree position in FIG. 7, the series of the feeding step is completed so that the sheet material feeding device is returned to the initial state (or the feeding standby state) as shown in FIG. 3. Accordingly, this embodiment is provided with the return assisting means comprising the return assisting member (return lever) 28 for contact and separation with respect to the elastic member 29, and the forcing means (return lever spring) 30 for forcing the return assisting member 28 to the direction moving away from the above-mentioned elastic member 29.

Furthermore, according to this embodiment, switching means for contacting the sheet material mounting portion (pressure plate) 7 with the feeding roller 9 at the time of feeding the sheet materials P, and for moving the sheet material mounting portion 7 away from the feeding roller 9 after finishing the feeding operation of the sheet materials P is provided. The switching means comprises forcing means (pressure plate spring) 53 for forcing in the direction of contacting the sheet material mounting portion 7 with the feeding roller 9, and a cam member (feeding roller cam) 32 for separating the sheet material mounting portion 7 from the feeding roller 9, resisting to the forcing means 53. Moreover, according to this embodiment, at the time of executing the return assisting operation by the above-mentioned return assisting means, the sheet material mounting portion 7 and the feeding roller 9 are separated, and according to the engagement of the sheet material mounting portion 7 with the above-mentioned return assisting member (return lever) 28 at the time the sheet material mounting portion 7 is separated from the feeding roller 9, the return assisting member 28 is contacted with the above-mentioned elastic member 29, resisting to the forcing means (return lever spring) 30.

In a stage before the sheet material P sending out operation while the feeding roller cam 32 is rotated to a position of 14 to 27 degrees in FIG. 7, the operation of contacting the return lever 28 to the rear surface of the elastic member 29 (the ON state of the return lever 28) is executed. The return lever 28 is contacted with the elastic member 29 before the real feeding operation for preventing the generation of the sheet material superimposed feed because the sheet material may climb up the elastic member 29 in the case the sheet material feeding operation is executed in a state with vibration, impact, or the like applied to the sheet material feeding device in stead of an ordinary state and the sheet material superimposed feed may be generated if the sheet material feeding operation is started in the climbing up state.

According to this embodiment as heretofore explained, since the return lever 28 is provided as the return assisting means for assisting the return by the contact with the elastic member at the time of returning the elastic member from the angle change after separating the sheet materials P by the elastic member 29, the above-mentioned elastic member 29 can return to the initial state after sending out the sheet materials P and the subsequent sheet materials can be pushed back to the initial mounting state, and thus a sheet material feeding device capable of avoiding generation of the superimposed feed of the subsequent sheet materials due to the insufficient separating force of the elastic member 29, and a recording apparatus comprising the sheet material feeding device can be provided.

Although an example of the case adopting the present invention in a sheet material feeding device for a recording apparatus (in the embodiment shown in the figures, an ink-jet recording apparatus) has been presented for the explanation, the present invention can be adopted similarly also in any sheet material feeding device as long as it is for feeding a sheet material (a typing paper, a transfer paper, a photosensitive paper, an electrostatic recording paper, a printing paper, an OHP sheet, an envelope, a postcard, a sheet document, or the like) mounted on a sheet material mounting portion to a sheet material processing portion such as a recording portion, a reading portion, and a processing portion. For example, it can be adopted to a sheet material feeding device in a recording apparatus (printer) as an information outputting apparatus for a personal computer, or the like, an image forming apparatus such as a copying machine and a facsimile, or various other kinds of the sheet material using appliances, or the like. The present invention includes the sheet material processing devices and the sheet material feeding devices in its scope.

Moreover, although an example of a serial type recording apparatus (a kind of a sheet material processing apparatus) for mounting recording means on a carriage moving along the sheet materials has been explained in the above-mentioned embodiment, the present invention can be adopted similarly also to a line type (including full line type) sheet material processing device of executing the processes of recording on a sheet material (material to be recorded) only by feeding the sheet material (sub scanning) without using a carriage, reading the sheet material (document), processing various kinds of sheet materials, or the like, and it includes them in its scope.

As it is apparent from the description above, according to the present invention, since a sheet material feeding device for sending out sheet materials mounted on a sheet material mounting portion one by one by a feeding roller, comprises an elastic member with the angle changed elastically by being abutted against by the sheet materials sent out, for separating the sheet materials by being moved over by the sheet materials, and return assisting means to be contacted with the elastic member for facilitating the return of the angle change of the elastic member to the original state, the elastic member can return to the initial state after sending out the sheet materials and the subsequent sheet materials can be pushed back to the initial mounting state so that a sheet material feeding device capable of avoiding generation of the sheet material superimposed feed due to an insufficient separating force of the elastic member can be provided.

According to the present invention, in addition to the configuration of the fist aspect, since the return assisting means comprises a return assisting member to be contacted with or separated from the elastic member, and first forcing means for forcing the return assisting member to the direction of moving away from the elastic member, or switching means for contacting the sheet material mounting portion with the feeding roller at the time of feeding the sheet materials, and separating the sheet material mounting portion from the feeding roller after finishing the sheet material feeding operation is provided, a sheet material feeding device capable of achieving the above-mentioned effect further efficiently can be provided.

According to the present invention, since the switching means comprises second forcing means for forcing the sheet material mounting portion to the direction of contacting with the feeding roller, and a cam member for separating the sheet material mounting portion from the feeding roller, resisting to the second forcing means, or the sheet material mounting portion and the feeding roller are separated at the time of executing the return assisting operation of the return assisting means, a sheet material feeding device capable of achieving the above-mentioned effect further efficiently can be provided. According to the sixth aspect of the present invention, since the return assisting member is contacted with the elastic member, resisting to the first forcing means according to engagement of the sheet material mounting portion with the return assisting member at the time the sheet material mounting portion is separated from the feeding roller, a sheet material feeding device capable of achieving the above-mentioned effect further efficiently can be provided.

According to the present invention, since the sheet material feeding device has the configuration according to any one of the first to sixth aspects in a recording apparatus comprising recording means for recording on a sheet material sent out from a sheet material feeding device, a recording apparatus comprising a sheet material feeding device, wherein the elastic member can return to the initial state after sending out the sheet materials and the subsequent sheet materials can be pushed back to the initial mounting state so that a sheet material feeding device capable of avoiding generation of the sheet material superimposed feed due to an insufficient separating force of the elastic member can be provided.

What is claimed is:

1. A sheet material feeding device for sending out sheet materials mounted on a sheet material mounting portion one by one by a feeding roller, comprising an elastic member with the angle changed elastically by being abutted against by the sheet materials sent out, for separating the sheet materials by being moved over by the sheet materials, and return assisting means to be contacted with the elastic member for facilitating the return of the angle change of the elastic member to the original state, wherein said return assisting means is spaced apart from said elastic member while the feeding roller supplies the sheet material and said return assisting means is in contact with said elastic member after termination of sheet material supply by the feeding roller to urge return of the elastic member, and wherein said return assisting means is in contact with a portion of the elastic member pressed and deformed by the sheet materials after termination of supply by the feeding roller to urge return of the elastic member.

2. The sheet material feeding device according to claim 1, wherein the return assisting means comprises a return assisting member to be contacted with or separated from the elastic member, and first forcing means for forcing the return assisting member to the direction of moving away from the elastic member.

3. The sheet material feeding device according to claim 2, comprising switching means for contacting the sheet material mounting portion with the feeding roller at the time of feeding the sheet materials, and separating the sheet material mounting portion from the feeding roller after finishing the sheet material feeding operation.

4. The sheet material feeding device according to claim 3, wherein the switching means comprises second forcing means for forcing the sheet material mounting portion to the direction of contacting with the feeding roller, and a cam member for separating the sheet material mounting portion from the feeding roller, resisting to the second forcing means.

5. The sheet material feeding device according to claim 4, wherein the sheet material mounting portion and the feeding roller are separated when the return assisting means performs the return assisting operation.

6. The sheet material feeding device according to claim 5, wherein in the return assisting member is contacted with the elastic member, resisting to the first forcing means according to engagement of the sheet material mounting portion with the return assisting member at the time the sheet material mounting portion is separated from the feeding roller.

7. The sheet material feeding device according to claim 3, wherein the sheet material mounting portion and the feeding roller are separated when the return assisting means performs the return assisting operation.

8. The sheet material feeding device according to claim 7, wherein the return assisting member is contacted with the elastic member, resisting to the first forcing means according to engagement of the sheet material mounting portion with the return assisting member at the time the sheet material mounting portion is separated from the feeding roller.

9. The sheet material feeding device according to claim 1, comprising switching means for contacting the sheet material mounting portion with the feeding roller at the time of feeding the sheet materials, and separating the sheet material mounting portion from the feeding roller after finishing the sheet material feeding operation.

10. The sheet material feeding device according to claim 9, wherein the switching means comprises second forcing means for forcing the sheet material mounting portion to the direction of contacting with the feeding roller, and a cam member for separating the sheet material mounting portion from the feeding roller, resisting to the second forcing means.

11. The sheet material feeding device according to claim 10, wherein the sheet material mounting portion and the feeding roller are separated when the return assisting means performs the return assisting operation.

12. The sheet material feeding device according to claim 11, wherein the return assisting member is contacted with the elastic member, resisting to the first forcing means according to engagement of the sheet material mounting portion with the return assisting member at the time the sheet material mounting portion is separated from the feeding roller.

13. The sheet material feeding device according to claim 9, wherein the sheet material mounting portion and the feeding roller are separated when the return assisting means performs the return assisting operation.

14. The sheet material feeding device according to claim 13, wherein the return assisting member is contacted with the elastic member, resisting to first forcing means according to engagement of the sheet material mounting portion with the return assisting member at the time the sheet material mounting portion is separated from the feeding roller.

15. A recording apparatus comprising recording means for recording on a sheet material sent out from a sheet material feeding device, wherein the sheet material feeding device has the configuration according to claim 1.

16. A sheet material feeding device comprising:

a mounting plate for supporting sheet materials;

a feeding roller for feeding the sheet materials mounted on the mounting plate;

a separating member to be tilted in the sheet material moving direction to the extent capable of allowing a climbing up movement of the sheet material in contact with the feeding roller by being pressed by the top end of the sheet materials moved by the feeding roller and inhibiting the climbing up movement of the sheets not in contact with the feeding roller; and a pushing member for pushing the separating member in the direction of returning the tilt after the climbing up movement of the top end of the sheet material in contact with the feeding roller over the separating member, wherein said pushing member is spaced apart from said separating member while said feeding roller feeds the sheet materials and said pushing member is in contact with said separating member after said feeding roller feeds the sheets to urge the return of said separating member, and wherein the pushing member is in contact with a portion of the separating member pressed and deformed by the sheet material to push the separating member.

17. The sheet material feeding device according to claim 16, comprising mounting plate moving means for disposing the mounting plate at a standby position with the mounted sheet materials not in contact with the feeding roller at the time of waiting without feeding the sheet materials, and moving the mounting plate to a feeding position capable of contacting the mounted sheet materials with the feeding roller at the time of feeding the sheet materials.

18. The sheet material feeding device according to claim 17, comprising a top end limiting surface for limiting the top end position of the sheet material such that the top end of the sheet materials mounted on the mounting plate are limited by the top end limiting surface at the time the mounting plate is at the standby position, and at least the uppermost sheet material of the sheet materials mounted on the mounting plate is at a position facing the separating member without limitation by the limiting surface at the time the mounting plate is at the feeding position.

19. The sheet material feeding device according to claim 18, wherein the pushing member is tilted in the sheet material moving direction at the time the mounting plate is at the feeding position.

20. The sheet material feeding device according to claim 18, wherein the mounting plate moving means moves the mounting plate such that the top end of the sheet materials mounted on the mounting plate is limited by the top end position limiting surface after having the sheet material fed by the feeding roller climbs over the separating member.

21. The sheet material feeding device according to claim 20, wherein the pushing member pushes the separating member after the mounting plate is moved such that the top end of the sheet materials mounted on the mounting plate is limited by the top end position limiting surface after having the sheet material fed by the feeding roller climbs over the separating member.

22. The sheet material feeding device according to claim 21, wherein the pushing member comprises a contact part to be contacted with the mounting plate such that the pushing member pushes the separating member according to movement of the mounting plate so as to be contacted with the contact part for pushing the contact part.

23. The sheet material feeding device according to claim 21, wherein the pushing member phases the separating member such that the separating member is tilted to the opposite side with respect to the tilt by the sheet materials being fed.

24. The sheet material feeding device according to claim 20, comprising a conveying roller for conveying the sheet material fed by the feeding roller, and the mounting plate moving means moves the mounting plate after having the "top end of the sheet materials mounted on the mounting plate limited by the top end position limiting surface after having the fed sheet material reach to the conveying roller.

25. The sheet material feeding device according to claim 16, wherein the separating member is a flexible sheet-like member supported in a cantilever-like form with the lower end fixed and the upper end provided freely.

26. A recording apparatus comprising the sheet material feeding device according to claim 16, and recording means for recording on a sheet material fed by the sheet material feeding device.

* * * * *

UNITED STATES PATENT AND TRADEMARK OFFICE

CERTIFICATE OF CORRECTION

PATENT NO. : 7,104,539 B2
APPLICATION NO. : 10/449107
DATED : September 12, 2006
INVENTOR(S) : Noboru Shimoyama It is certified that error appears in the above-identified patent and that said Letters Patent is hereby corrected as shown below:

ON THE TITLE PAGE, AT ITEM (75), Inventor:
"Noboru Shimoyama, Ohta-ku (JP)" should read --Noboru Shimoyama, Kanagawa (JP)--.

COLUMN 5:
Line 23, "a" should read --an--.

COLUMN 6:
Line 14, "stand by" should read --standby--.
Line 16, "stated" should read --started--.

COLUMN 7:
Line 67, "in stead" should read --instead--.

COLUMN 10:
Line 19, "in" should be deleted.

COLUMN 11:
Line 39, "material" should read --materials--.

COLUMN 12:
Line 25, "phases" should read --pushes--.
Line 33, ""top"" should read --top--.

Signed and Sealed this

Twenty-fourth Day of April, 2007

JON W. DUDAS
*Director of the United States Patent and Trademark Office*